US006148725A

United States Patent [19]

Knauer et al.

[11] Patent Number: 6,148,725

[45] **Date of Patent: *Nov. 21, 2000**

[54] RUBBER CYLINDER SLEEVE FOR OFFSET WEB-FED ROTARY PRINTING MACHINES

[75] Inventors: Peter Knauer, Münster; Eduard Hoffmann, Bobingen; Paul Steidle, Grossaitingen, all of Germany

[73] Assignee: MAN Roland Druckmaschinen AG, Offenbach am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/893,950

[22] Filed: Jul. 16, 1997

[30] Foreign Application Priority Data

Jul. 16, 1996 [DE] Germany ..... 196 28 555

[51] Int. Cl.[7] ..... B41F 7/02

[52] U.S. Cl. ..... 101/217; 101/376; 492/48

[58] Field of Search ..... 101/216, 217, 101/368, 375, 376, 401.1; 492/48–53, 56

[56] References Cited

U.S. PATENT DOCUMENTS

| | | | |
|---|---|---|---|
| 3,203,848 | 8/1965 | Ross . | |
| 4,025,685 | 5/1977 | Haren et al. | 101/401.1 |
| 4,144,812 | 3/1979 | Julian | 101/375 |
| 4,903,597 | 2/1990 | Hoage et al. . | |
| 5,304,267 | 4/1994 | Vrotacoe et al. . | |
| 5,323,702 | 6/1994 | Vrotacoe et al. . | |
| 5,351,615 | 10/1994 | Köbler et al. . | |
| 5,429,048 | 7/1995 | Gaffney et al. . | |
| 5,440,981 | 8/1995 | Vrotacoe et al. . | |
| 5,599,266 | 2/1997 | Landl et al. | 492/49 |
| 5,654,100 | 8/1997 | Kobler et al. | 101/375 |
| 5,768,990 | 6/1998 | Vrotacoe et al. . | |

FOREIGN PATENT DOCUMENTS

| | | |
|---|---|---|
| 313 511 | 4/1989 | European Pat. Off. . |
| 514 344 | 11/1992 | European Pat. Off. . |
| 43 20 923 | 1/1994 | Germany . |
| 43 23 750 | 1/1995 | Germany . |
| 2-243344 | 9/1990 | Japan . |
| 5-301483 | 11/1993 | Japan . |
| 6-24172 | 2/1994 | Japan . |
| 6-48063 | 2/1994 | Japan . |
| 6-64363 | 3/1994 | Japan . |
| 6-198837 | 7/1994 | Japan . |
| WO 94/02259 | 2/1994 | WIPO . |

*Primary Examiner*—Ren Yan

*Attorney, Agent, or Firm*—Cohen, Pontani, Lieberman & Pavane

[57] ABSTRACT

A cylinder sleeve for all offset web-fed rotary printing machine comprising a carrier sleeve having a joint location and about which is arranged at least one compressible layer, also having a joint location. Another layer of non-expandable material may be used on top of or within the compressible layer. The non-expandable layer may also have a joint location. A seamless outer layer is provided and disposed about the compressible layer and the non-expandable layer, if so provided.

12 Claims, 2 Drawing Sheets

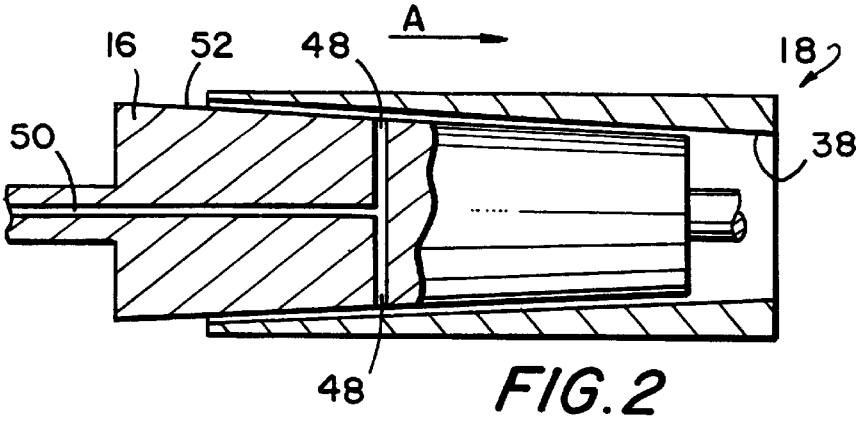
FIG. 2
FIG. 3
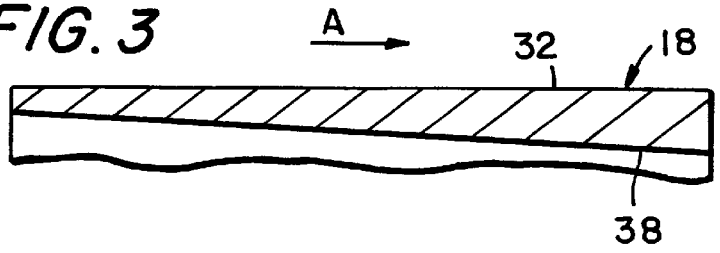
FIG. 4
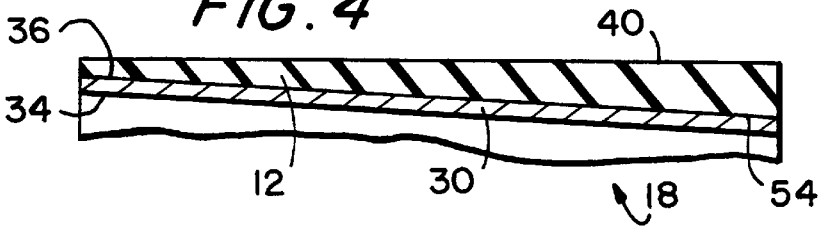
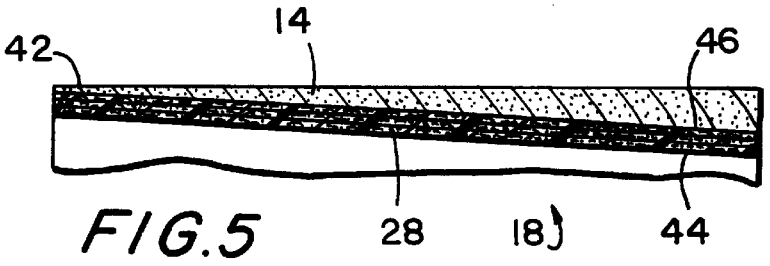
FIG. 5

RUBBER CYLINDER SLEEVE FOR OFFSET WEB-FED ROTARY PRINTING MACHINES

BACKGROUND OF THE INVENTION

1. Field of the Invention

The present invention is directed to a cylinder sleeve and, more particularly, to a lubber cylinder sleeve for an offset web-fed rotary printing machine.

2. Description of the Related Art

Rubber cylinder sleeves are disclosed in U.S. Pat. Nos. 5,429,048, 5,323,702, 5,440,981 and 5,304,267. The sleeves disclosed in these references include intermediate and lower layers which must disadvantageously be at least partially continuous, or endless generally increasing production costs.

Another type of rubber cylinder sleeve is disclosed in U.S. Pat. No. 5,351,615. This cylinder sleeve is formed by first securing a rubber blanket to a carrier plate, such as, for example, by gluing, with both the rubber blanket and carrier plate being substantially planar prior to being, formed into a cylinder. This combination is then formed into a cylinder sleeve by bring the ends of the combiner rubber blanket and carrier plate into confronting relation with each other and by joining the respective confronting ends together, preferably by welding or gluing. Although this arrangement produces a virtually gap-free joint, a connection seam remains on the surface of the finished rubber sleeve at the joint. This disadvanitageously presents an imperfect outer surface on the cylinder sleeve and adversely impacts the print quality of sleeves so constructed.

SUMMARY OF THE INVENTION

It is accordingly an object of the present invention to produce a rubber cylinder sleeve particularly suited for an offset web-fed rotary printing machine that overcomes the above-mentioned shortcomings of the prior art, that may be economically produced, and that is capable of at least the same printing quality and printing behavior as prior art sleeves.

In general, a rubber cylinder sleeve comprises a carrier sleeve, preferably made of metal or reinforced glass-fiber. Elastic properties inherent to the preferred metal and glass-fiber materials permit the carrier sleeve to radially expand when a compressed gas, such as air, for example, is outwardly directed at an inner surface of the carrier sleeve. These inherent elastic properties also permit the carrier sleeve to elastically contract and return to its non-expanded condition upon removal of the compressed gas, thereby securing the cylinder sleeve on the transfer cylinder. The inherent elasticity of the carrier sleeve facilitates sliding the cylinder sleeve onto and off of a transfer cylinder or rubber blanket cylinder (as this device is referred to for printing machines that employ the indirect method of printing). Openings may be provided in the transfer cylinder to direct the compressed air toward the inner surface of the carrier sleeve thereby facilitation expansion thereof. Once the cylinder sleeve is in the desired position and the source of compressed air is removed, the carrier sleeve will contract, thereby firmly seating the cylinder sleeve on the transfer cylinder. Accordingly, a cylinder sleeve configured according to the present invention may advantageously be slid onto and off of the transfer cylinder through an opening in a sidewall of the printing machine.

At least one additional layer which is preferably compressible, is applied—directly or indirectly—about the outer perimeter of the carrier sleeve. This compressible layer contains air inclusions such as, for example, air-bubbles embedded within the material of the compressible layer. At least one cover layer, which may be made from elastomeric material, for example, is provided over the compressible layer. This cover layer permits the images to be printed to be transferred from a term cylinder or printing form, e.g. an offset printing plate or a sleeve-type offset printing form, to printing stock. The cover layer may also contain air inclusions, in which case the cover layer is less compressible than the above-described compressible layer.

Another layer which is not expandable, e.g. which is made of a hard elastomeric material or that has short fibers or threads embedded within a hard elastomeric material, is preferably provided between the compressible layer and the cover layer. Alternatively, a nonexpandable layer or nonexpandable particles, such as threads or pieces of threads, can also be introduced directly into the compressible layer discussed above to render a portion of the compressible layer nonexpandable.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views:

FIG. 2 is a cross-sectional view of a carrier sleeve having a generally conical internal cross-section configured according to the present invention and partially disposed on a transfer cylinder, the transfer cylinder being shown in partial cross-section;

FIG. 3 is a partial sectional view of the carrier sleeve of FIG. 2;

FIG. 4 is a partial sectional view of an alternative embodiment of a carrier sleeve having a metal inner carrier and a plastic cover layer and configured according to the present invention; and FIG. 5 is a partial sectional view of an alternative embodiment of a carrier sleeve having a glass-fiber reinforced inner carrier and an epoxy resin outer coating and configured according to the present invention.

DETAILED DESCRIPTION OF THE PRESENTLY PREFERRED EMBODIMENTS

The present invention provides a rubber cylinder sleeve that may be easily slid onto and off of the transfer cylinder of a web-fed rotary printing machine due, in part, to the elastic properties inherent in the preferred materials used to construct the invention cylinder sleeve. The outer-most layer of the inventive cylinder sleeve may be slightly compressible, but only to a limited degree so as not to distort or otherwise impact the printing quality of the inventive device. Various compressible and nonexpandable layers may be provided, in generally layered relation, about a carrier sleeve, to form the inventive cylinder sleeve. By varying the number and composition of the layers, and by varying the materials used to construct the several layers, numerous embodiments of the present invention are possible.

Figure 1:
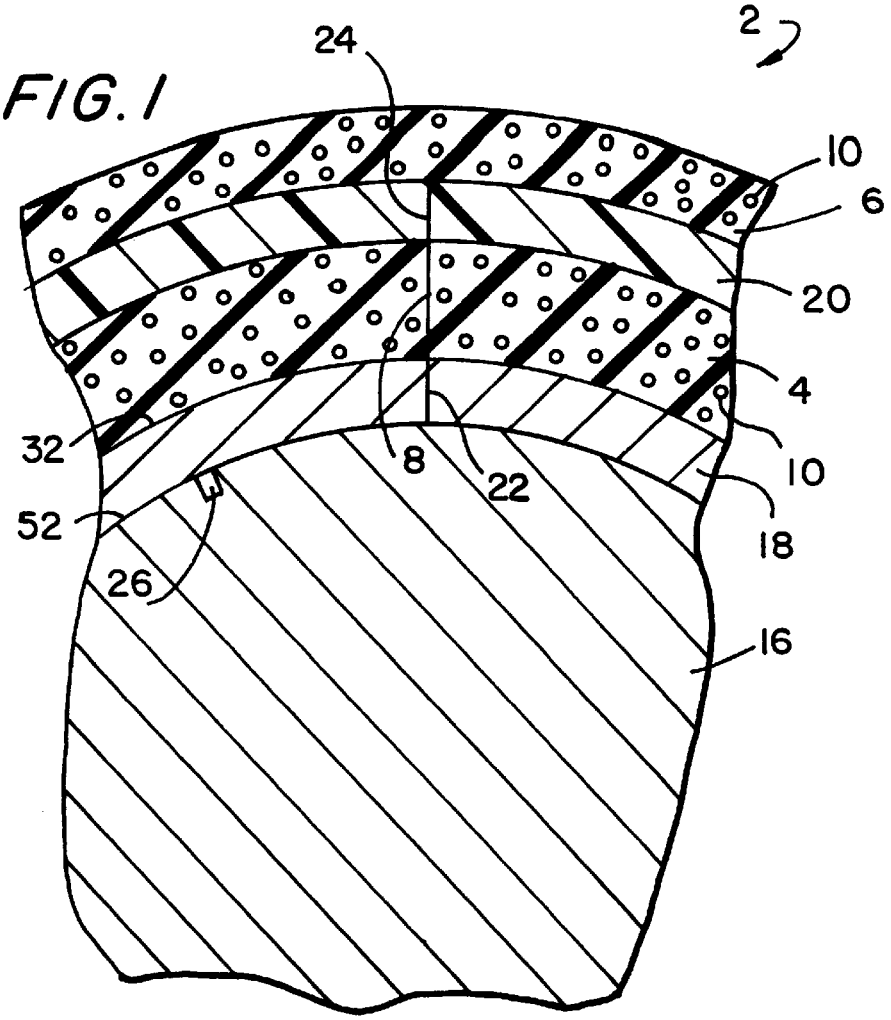
FIG. 1 is a partial cross-sectional view of a cylinder sleeve configured according to the present invention and disposed on a transfer cylinder.

Referring now to the drawings in detail, FIG. 1 depicts a blanket cylinder sleeve 2 according to the present invention. The cylinder sleeve 2 is removably mountable on a transfer cylinder 16 (also referred to as a blanket cylinder) of a web-fed rotary printing machine (not shown). The transfer cylinder 16 includes a plurality of openings or nozzles 26 circumferenitially disposed about its outer surface 52 through which a compressed gas such as, for example, air, may pass. The blanket cylinder sleeve 2 or printing blanket comprises a carrier sleeve 18 which is preferably expandable by the compressed air when the cylinder sleeve 2 is slid onto and off the transfer cylinder 16. A compressible layer 4 may be secured about the carrier sleeve 18 by glue, vulcanization or other known securing methods or means. The compressible layer 4 may contain integrally formed air inclusions 10 in the form of air bubbles. Alternatively, other compressible gases or liquids may be provided in the inclusions 10 of layer 4. The air inclusions 10 and general compressibility of layer 4 permit the carrier sleeve 18 to freely expand (encouraged by the compressed air from nozzles 26) and contract as the compressed air is direct toward and removed from the inner surface 38 (FIG. 2) of the carrier sleeve 18.

A nonexpandable layer 20, preferably made of a hard elastomer layer having short fibers interspersed therethrough, may optionally be disposed about the compressible layer 4. The non-expandable layer 20 limits the expansive displacement of the outer surface 32 of the carrier sleeve 18 in response to the compressed air, while the compressible layer 4 permits the carrier sleeve 18 to freely expand and contract. A cover layer 6, that may be made from an elastic material and that can be used as the print surface for offset printing, may be circumferentially displaced about the nonexpandable layer 20. If the nonexpandable layer 20 is not provided, the cover layer 6 may be disposed directly about the compressible layer 4. The cover layer 6 may optionally contain inclusions 10 having a compressible liquid or gas distributed therein to facilitate compression and expansion of the cover layer 6. The cover layer 6 is thus, at least partly compressible—yielding corresponding advantageous improvements over the prior art such as, for example, improved printing results, printing behavior, and web guidance.

With continued reference to FIG. 1, the carrier sleeve 18 is preferably made from steel and advantageously formed from a generally planar plate whose ends are welded together resulting in a joint location 22 such as, for example, a weld seam. Similarly, the compressible layer 4 is formed from a flexible sheet of compressible material which is then wrapped around the carrier sleeve 18 to form a continuous compressible layer 4 disposed about the carrier sleeve 18. To accomplish this, oppositely located free ends (not shown) of the compressible sheet material are spliced together or otherwise joined using known joinery means to form a joint location 8. If a nonexpandable layer 20 is provided about the compressible layer 4, a joint location 24 may likewise be formed thereon. As used herein, the terms joint, joint location and seam may refer to, by way of non-limiting example, the location at which two edges or ends of a generally planar component are joined as the component is formed into a generally cylindrical or conical member.

In contrast to the above-discussed elements, the cover layer 6 is configured as a longitudinally continuous tube or cylinder having no joints or seams.

When arranging the individual layers of the inventive cylinder sleeve 2, the joint locations 22, 8, 24 of the carrier sleeve 18, compressible layer 4, and non-expandable layer 20, respectively, need not lie on top of one another as shown in FIG. 1, but instead, may be circumferenitially spaced apart in any manner and without regard to the special relationship between the various joint locations 22, 8, 24.

Figure 1A:
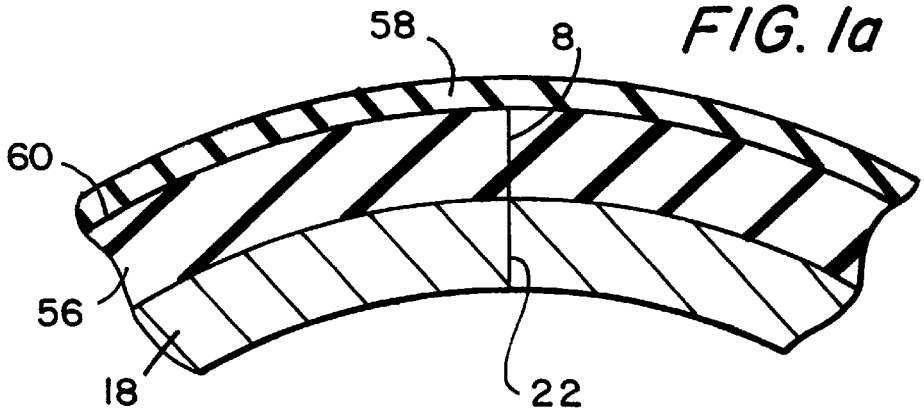
FIG. 1*a* is a partial cross-sectional view of a carrier sleeve having an offset rubber blanket and configured according to the present invention.

In an alternative embodiment depicted in FIG. 1*a*, the inventive cylinder sleeve 2 may comprise a steel, aluminum or carbon-fiber plastic carrier sleeve 18 having a joint location 22 produced by welding the ends or edges of the carrier sleeve 18 sheet material together to form a cylinder. A conventional offset printing blanket 56 having an integral compressible layer, a joint location 8, and an outermost surface 60 may be applied circumferentially about the carrier sleeve 18, i.e. in place of the above-described compressible layer 4. The printing blanket is applied to the carrier sleeve 18 by gluing, vulcanization, or other similar affixation means or methods. The outermost surface 60 of the conventional printing blanket 56 is then removed, e.g. by grinding, and a continuous, seamless, cover layer 58 is applied (i.e. vulcanized) in its place. This method of production and the resultant cylinder sleeve 2 are substantially cheaper and have a number of advantages over known sleeves. For example, when a nonexpandable layer 20 is arranged on top (as viewed in FIG. 1*a*) of the blanket 56, the respective joint locations 24, 8 lie on top of each other, since they represent the ends of the conventional blanket 56 which was glued onto the carrier sleeve 18. However, the joint locations 24, 8 may—but need not necessarily—be arranged directly over the joint location 22 in an advantageous manner.

The inventive cylinder sleeve 2 offers a multitude of possible uses which are not limited to offset web-fed rotary printing machines. For example, the cylinder sleeve 2 may also be used in other indirect printing methods such as indirect gravure printing or alternatively, it may can be used as a roller.

A particular advantage of the inventive cylinder sleeve 2 is that a circumferential register, that is, the arrangement of the sleeve on the cylinder in a predetermined circumferential position on the transfer cylinder 16, is no longer required. However, the known essential advantages typical of finite transfer carriers (rubber blankets or rubber sleeves) can nevertheless be achieved in production.

In a preferred embodiment, only the cover layer 6 (i.e. the layer receiving the printing image) is elastic, and preferably, only the lower region or portion of the cover layer 6 is constructed with air inclusions 10 or possibly air channels which are open at the bottom, i.e. facing the carrier sleeve 18. Such a layer 6 may include nonexpandable material, such as threads or thread pieces, and the layer 6 may be arranged directly on the carrier sleeve 18.

It is also possible to produce the carrier sleeve 18 from fiber-reinforced hard rubber—with or without a seam—which is expandable by means of compressed air. A compressible layer 4 can be placed over the rubber carrier sleeve 18 followed by a semi-compressible layer which may be fiber-reinforced, followed by a cover layer 6—this configuration being highly advantageous.

Referring next to FIGS. 2–5, a carrier sleeve 18 having a substantially conical inner jacket surface 38 (when viewed in cross-section) will now be described in greater detail. For the sake of simplicity, the reference numbers of the previous embodiment shown in FIG. 1 are used in FIGS. 2–5 for similar elements, where appropriate.

FIG. 2 depicts a carrier sleeve 18 partially disposed on a generally conical transfer cylinder 16 having an outer or jacket surface 52. The carrier sleeve 18 includes an inner jacket surface 38 shaped complimentarily with the transfer cylinder 16, i.e. substantially conical. Arranged roughly in the center of the transfer cylinder 16 is a radial bore or channel 50 connected to radial bore holes 48 located at least near an end region of the jacket surface 52. The channel 50 and bore holes 48 guide compressed air from a compressed air source (not shown) against the inner jacket surface 38 of the carrier sleeve 18 to encourage the carrier sleeve 18 to expand as the cylinder sleeve 2 is slid onto and off of the transfer cylinder 16.

As a result of the complementary conical shapes of the transfer cylinder 16 and carrier sleeve 18, there exists a gap or clearance between these parts as the carrier sleeve 18 is initially slid onto the transfer cylinder 16. Consequently, bevels or other similar guidance or alignment devices are not required to assist in placing the carrier sleeve 18 (and cylinder sleeve 2) onto the transfer cylinder 16. The compressed air is also advantageously distributed in this gap as the carrier sleeve 18 is slid onto the transfer cylinder 16.

Referring next to FIG. 3, the carrier sleeve 18 of FIG. 2 is partially shown in enlarged longitudinal cross-section. In this embodiment, the carrier sleeve 18 is formed of a metal, preferably nickel, having a substantially cylindrical outer shape as defined by outer surface 32. Due to the generally cylindrical outer shape and generally conical inner shape of the carrier sleeve 18 (as defined by the inner jacket surface 38), the cross-sectional wall thickness of the carrier sleeve 18 increases in the direction of arrow A of FIGS. 2 and 3, i.e. toward the end ot the carrier sleeve 18 having a smaller inner diameter. The carrier sleeve 18 depicted in FIG. 3 may be produced by electroplating and subsequent polishing of the outer surface 32.

Referring next to the embodiment depicted in FIG. 4, the carrier sleeve 18 is formed of a metal inner carrier 30, preferably made of nickel and having an inner jacket surface 34 and an outer jacket surface 36, both of which define a generally conical shape. In this embodiment, the inner carrier 30 may be formed initially from a metal sheet having longitudinally opposite ends or edges which are bent toward one another as the sheet is formed into a generally conical shape. Once bent thusly, the edges lie confrontingly opposite one another and may be joined together by, for example, laser-welding, to generally form a joint location 22 (FIG. 1). A stationary plastic cover layer 12 having an outer surface 40 that defines a generally cylindrical shape and an inner surface 54 that defines a generally conical shape, is arranged on the inner carrier 30. In a preferred embodiment, the plastic cover layer 12 is formed of hard rubber and advantageously vulcanized or glued onto the inner carrier 30 and then polished. The plastic cover layer 12 may be constructed with or without a joint.

An alternative embodiment of the carrier sleeve 18 is shown in part in FIG. 5. Here, the carrier sleeve 18 is formed of a multi-layered glass-fiber reinforced plastic (GFP) 28 having substantially conically shaped inner and outer surfaces 44 and 46, respectively. An epoxy resin coat 14 having a substantially cylindrically shaped outer surface 42 is disposed circumferenitially about the multi-layered glass-fiber plastic 28, which is preferably a rolled glass-fiber coat.

The various carrier sleeve 18 embodiments described above and shown in FIGS. 2–5 may include one of the coatings described above, e.g. stationary plastic or epoxy resin.

Thus, while there have shown and described and pointed out fundamental novel features or the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A cylinder sleeve for an offset printing machine, said cylinder sleeve comprising:

a carrier sleeve having a joint location, said carrier sleeve being sized and shaped so as to be expandable by a compressed gas;

a compressible layer arranged about said carrier sleeve and having a joint location; and a jointless outermost cover layer of the cylinder sleeve arranged about said compressible layer, said cover layer being compressible and containing air inclusions which do not open at an outer surface of the cover layer.

2. The cylinder sleeve of claim 1, further comprising a non-expandable layer having a joint location and being disposed between said compressible layer and said cover layer.

3. The cylinder sleeve of claim 2, wherein said non-expandable layer is partly comprised of a material selected from a group consisting of non-expandable woven fabric, non-expandable woven threads, pieces of woven fabric, and pieces of thread.

4. The cylinder sleeve of claim 2, wherein said joint location of said carrier sleeve includes a weld seam, each of said compressible layer and said non-expandable layer having respective joined abutting ends that form said respective joint locations.

5. The cylinder sleeve of claim 4, wherein said compressible layer and said non-expandable layer are respectively affixed to said carrier sleeve and said compressible layer using affixation means selected from a group consisting of gluing and vulcanization.

6. The cylinder sleeve of claim 4, wherein said joint locations are gluing locations.

7. The cylinder sleeve of claim 1, wherein said compressible layer contains air inclusions.

8. The cylinder sleeve of claim 1, wherein said cover layer is less compressible than said compressible layer.

9. The cylinder sleeve of claim 1, wherein said compressible layer is an offset rubber blanket affixed to said carrier sleeve, said rubber blanket having an outer layer including a joint location.

10. The cylinder sleeve of claim 9, wherein said jointless layer is vulcanized to said compressible layer.

11. The cylinder sleeve of claim 1, wherein said carrier sleeve is formed of fiber-reinforced hard rubber.

12. The cylinder sleeve of claim 1, wherein said carrier sleeve includes a substantially conical inner jacket surface.

* * * * *